US005272794A

United States Patent [19]

Hamatani et al.

[11] Patent Number: 5,272,794

[45] Date of Patent: Dec. 28, 1993

[54] FLEXIBLE CLOSURE DEVICE

[75] Inventors: Tsutomu Hamatani, Namerikawa; Yutaka Tominaga, Toyama, both of Japan

[73] Assignee: Yoshida Kogyo K.K., Tokyo, Japan

[21] Appl. No.: 47,035

[22] Filed: Apr. 12, 1993

Related U.S. Application Data

[63] Continuation of Ser. No. 803,012, Dec. 4, 1991.

[30] Foreign Application Priority Data

Nov. 20, 1990 [JP] Japan ..... 2-12173[U]

[51] Int. Cl.[5] ..... A44B 17/00

[52] U.S. Cl. ..... 24/576; 24/587; 383/63

[58] Field of Search ..... 24/576, 577, 578, 587, 24/399, 400; 383/63, 65

[56] References Cited

U.S. PATENT DOCUMENTS

| | | | |
|---|---|---|---|
| 2,558,367 | 6/1951 | Madsen | 24/576 |
| 2,794,228 | 6/1957 | Teher | 24/576 |
| 2,960,561 | 11/1960 | Plummer | 24/399 |
| 3,173,184 | 3/1965 | Ausnit | 24/399 |
| 3,459,870 | 8/1969 | Plummer | 383/63 |
| 3,654,049 | 4/1972 | Ausnit | 24/576 |
| 3,918,131 | 11/1975 | Ausnit | 24/576 |
| 4,819,309 | 4/1989 | Behymer | 24/587 |
| 4,925,318 | 5/1990 | Sorensen | 383/63 |

FOREIGN PATENT DOCUMENTS

| | | |
|---|---|---|
| 935885 | 9/1963 | United Kingdom . |
| 2014232 | 8/1979 | United Kingdom . |

*Primary Examiner*—Victor N. Sakran

*Attorney, Agent, or Firm*—Hill, Steadman & Simpson

[57] ABSTRACT

A flexible closure device comprises a pair of elongated fastener strips each including a web portion and a marginal portion. The marginal portion includes a plurality of interlocking ribs terminating in hooked coupling heads for coupling engagement with corresponding coupling heads. The middle rib has its hooked coupling heads project slightly beyond the rest of ribs. One side surface, of the middle rib, devoid of the hooked coupling head is slightly inclined downwardly outwardly relative to the general plane of the middle rib.

4 Claims, 2 Drawing Sheets

FLEXIBLE CLOSURE DEVICE

This is a continuation of application Ser. No. 07/803,012, filed Dec. 4, 1991.

BACKGROUND OF THE INVENTION

1. Field of the Invention

The present invention relates to flexible continuous closure device of the type including a pair of elongated strips each having a plurality of continuous interlocking ribs along its one longitudinal marginal edge, the continuous interlocking ribs being releasably interlockable with the mating interlocking ribs of the coacting opposite fastener strip either by a slider reciprocally mounted on the strip or merely by fingers.

2. Description of the Prior Art

A typical flexible closure device of the type described is disclosed in British Patent Application GB 2014232A. The disclosed closure device comprises a pair of elongated fastener strips each having a plurality of continuous interlocking ribs. Usually, these ribs are all of the same height. And, the ribs and exactly the opposite side surfaces thereof stand substantially perpendicular to the general plane of the strip.

Although this closure device is somewhat satisfactory in that they are simple in construction, easy to manipulate, and less expensive, they still suffer the following drawbacks. As all the ribs of the strip are of the same height, there is no reference point for aligning the elongated ribs of one strip with those of the opposite strip. This has objectinably rendered difficult and time-consuming the alignment and hence the interlocking operation of the strips. Besides, the mating ribs of the coacting strips of the closure device are manufactured with less allowance for increased watertightness and airtightness. This has made it extremely difficult for the ribs to wedge into the inter-rib grooves of the coacting strip, thus rendering the opening and closing operations of the closure device sluggish.

SUMMARY OF THE INVENTION

With the foregoing difficulties in view, it is therefore an object of the present invention to provide a flexible closure device in which the mating ribs of the coacting strips are easily aligned with each other for interlocking; and, even if rendered high in airtightness and water tightness, the closure device enjoys light and smooth opening and closing operations for a prolonged period of time.

According to the present invention, there is provided A flexible closure device comprising a pair of elongated fastener strips each including a web portion to have its one longitudinal edge attached to an article and a marginal portion formed integrally along the other longitudinal edge of the web portion, the marginal portion including a base plank and a plurality of interlocking ribs extending substantially perpendicularly to the base plank, all the ribs but a rib proximal to the web portion terminating in hooked coupling heads for coupling engagement with corresponding coupling heads of the coacting opposite fastener strip, the middle rib having its hooked coupling heads project slightly beyond the rest of ribs and one side surface, of the middle rib, devoid of the hooked coupling head being slightly inclined downwardly outwardly relative to the general plane of the middle rib.

Many other advantages and features of the present invention will become manifest to those versed in the art upon making reference to the detailed description and the accompanying sheets of drawings which preferred structural embodiments incorporating the principles of the present invention are shown by way of illustrative example.

DETAILED DESCRIPTION

Figure 1:
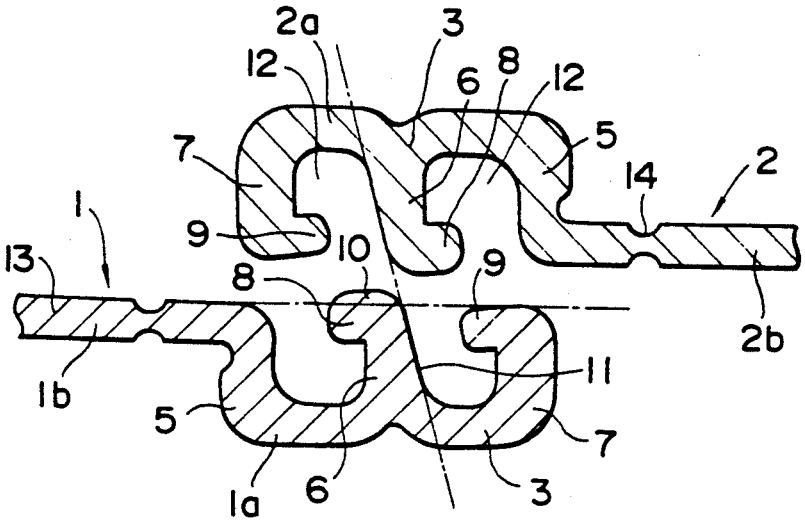
FIG. 1 is a cross-sectional view of a closure device according to the present invention, showing a pair of coacting fastener strips in uncoupled disposition.
Figure 2:
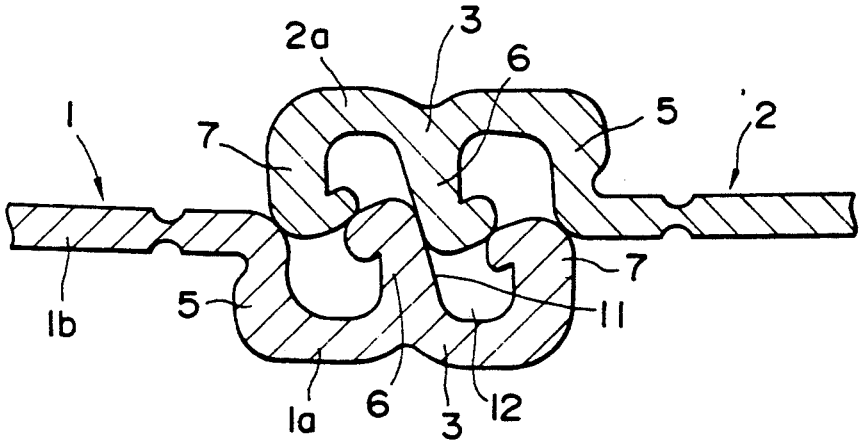
FIG. 2 is a view similar to FIG. 1 but showing the fastener strips being on the verge of coming into coupling engagement with each other.
Figure 3:
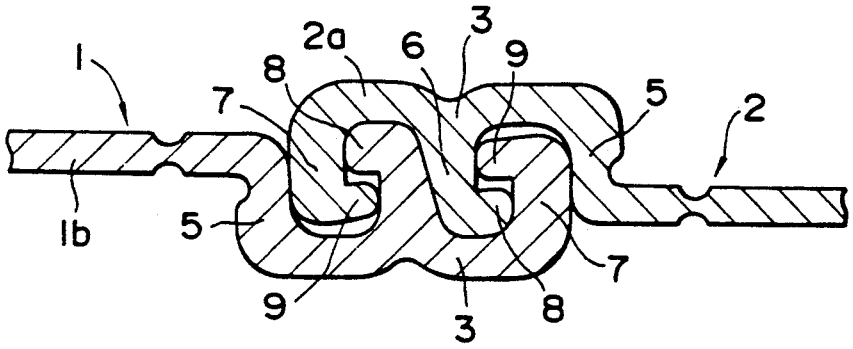
FIG. 3 a is also a view similar to FIG. 1, but showing the fastener strips in coupled disposition.

FIGS. 1 through 3 inclusive shows a flexible closure device according to the present invention, and specifically a series of sequential steps of the coupling operation of the closure device. The closure device according to the present invention comprises a pair of elongated fastener strips 1, 2 made from a plastic such as polyvinyl chloride, polyethylene, polypropylene and the like. The fastener strips 1, 2, identical in cross-section, are interlockable with each other in airtight and watertight manner, as shown in FIG. 3.

Each of the fastener strips 1, 2 comprises a web portion 1*b*, 2*b* to have its one longitudinal edge attached to an article such as clothings, baggages, pouches, etc. and a thicker marginal portion 1*a*, 2*a* formed integrally along the other longitudinal edge of the web portion 1*b*, 2*b*. The marginal portion 1*a*, 2*a* includes a base plank 3 and a plurality of elongated interlocking ribs 5, 6, 7 extending substantially perpendicularly to the base plank 3 and running throughout the full length of the fastener strip 1, 2. The ribs, 5, 6, 7 are referred to as the first, the second and the third ribs 5, 6, 7, from the proximal end to the distal end of the marginal portion 1*a*, 2*a*. The second and third ribs 6, 7 terminate in the hooked coupling heads 8, 9, respectively, for firm coupling engagement with the corresponding hooked coupling heads 9, 8, respectively, of the coacting opposite fastener strip 2, as better shown in FIG. 3. The hooked coupling heads 8, 9 both face towards the web portion 1*b*, 2*b*.

It is to be noted that all the interlocking ribs 5, 7 are as high as one another except the middle rib 6 which is a little higher than the rest of ribs 5, 7, so that the middle interlocking rib 6 has its hooked coupling bead 8 project beyond the level of the rest of ribs 5, 7 indicated by a phantom line in FIG. 1. This ensures that, when the first and second fastener strips 1, 2 are brought closer to each other for interlocking engagement, the hooked coupling heads 8, 8 of the two highest ribs 6, 6 of both strips 1, 2 first bamp against each other, hence acting as efficient reference point for bringing the fastener strips 1, 2 ready for interlocking with each other at ease.

It is also to be noted that one side surface 11, of the middle rib 6, devoid of the hooked coupling heads 8 is slightly inclined downwardly outwardly relative to the general plane of the middle rib 6, as also indicated by another phantom line in FIG. 1. This inclination of the surface 11 facilitates the middle rib 6 of the fastener strip 2 wedging into an elongated groove 12 partly defined by and between the adjacent ribs 6, 7, as better shown in FIG. 2.

Figure 4:
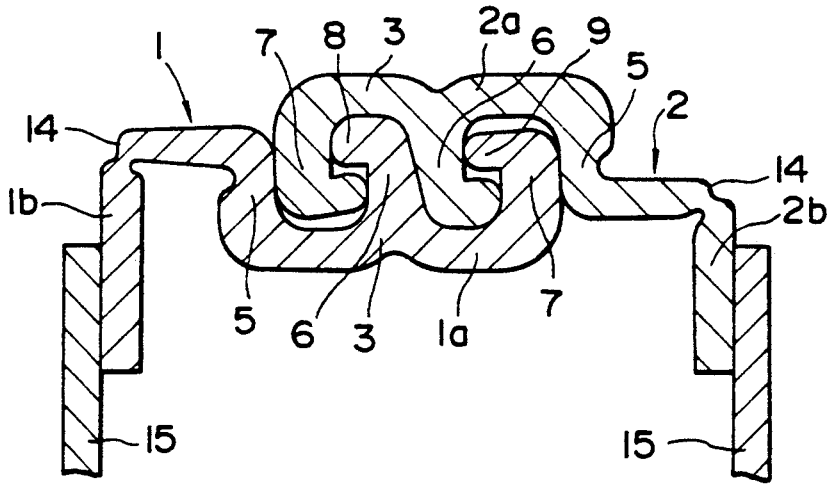
FIG. 4 is a cross-sectional view of the closure device of FIG. 1 attached to opening edges of a pouch.

Each of the fastener strips 1, 2 may have a slight recession or notch 14 formed in a suitable position in the web portion 1*b*, 2*b* and extending longitudinally of the respective fastener strip 1, 2 to thus accommodate easier flexing of the web portion 1*b*, 2*b* as shown in FIG. 4. This facilitates attachment of the closure device to opening edges 15, 15 of opposed side pieces of a pouch, baggage or the like. Furthermore, the recession 14 helps to prevent such bending from having an influence on the interlocking operation of the coupling marginal portion 1*a*, 2*a*.

Figure 5:
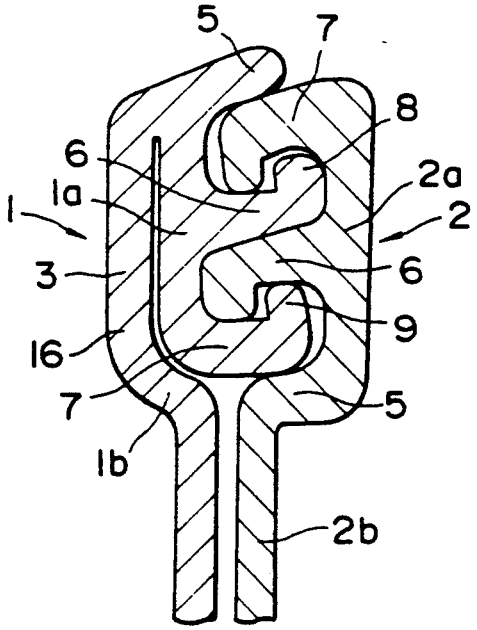
FIG. 5 is a cross-sectional view of a closure device according to another embodiment of the present invention.

FIG. 5 shows another embodiment which is substantially identical with the preceding embodiment except that one fastener strip 1 is folded back with its web portion 1*b* laid flat on its marginal portion 1*a*, while the other fastener strip 2 is identical in construction with those in the preceding embodiment, so that the web portions 1*b*, 2*b* of the coacting fastener strips 1, 2, respectively, are disposed in opposed and parallel relation to each other. This arrangement makes the closure device suitable for attachment to a thin or flat pouch or the like article.

With the construction set forth above, the closure device according to the present invention enjoys the following advantages.

The coacting fastener strips can be guided into a position ready for interlocking with each other at great ease.

Furthermore, even if the fastener strips are manufactured with little allowance for increased watertightness and airtightness, the closure device still enjoys light and smooth opening and closing operation for a prolonged period of time.

Obviously, various modifications and variations of the present invention are possible in the light of the above teaching. It is therefore to be understood that within the scope of the appended claims the invention may be practiced otherwise than as specifically described.

What is claimed is:

1. A flexible closure device comprising a pair of elongated fastener strips each including a web portion to have its one longitudinal edge attached to an article and a marginal portion formed integrally along the other longitudinal edge of the web portion, the marginal portion including a base plank and a plurality of interlocking ribs extending substantially perpendicularly to the base plank, all the ribs but a rib proximal to the web portion terminating in hooked coupling heads for coupling engagement with corresponding coupling heads of the coacting opposite fastener strip, when uncoupled the middle rib having its hooked coupling head projected beyond the rest of the ribs and projected beyond said web portion adjacent said marginal portion; the middle rib being tapered having one side surface of the middle rib, opposite the protrusion of the hooked coupling head, being slightly inclined outwardly from the web in a direction from the coupling heads toward the base plank, relative to the general plane of the middle rib, said middle rib so adapted to align said pair of fastening strips together and guide said pair into interlocking relationship.

2. A flexible closure device according to claim 1, each of the fastener strips having a recession formed in a suitable position in the web portion and extending longitudinally of the respective fastener strip.

3. A flexible closure device according to claim 1, wherein one fastener strip is folded back with its web portion laid flat on its marginal portion, so that the web portions of the coacting fastening strips respectively, are disposed in opposed and parallel relation to each other.

4. A flexible closure device comprising a pair of elongated fastener strips each including a web portion having one end portion thereof attachable to an article and a marginal portion formed integrally to a respective other end of the web portion, the marginal portion including a base plank and a plurality of ribs extending from said base plank, all the ribs but a proximal rib to the web portion terminating in hooked coupling heads for coupling engagement with corresponding coupling heads of a coacting opposite fastener strip, the proximal rib connected to said web portion at said respective other end portion, and in an uncoupled state a next adjacent rib, next adjacent said proximal rib having its hooked coupling head projected further from said base plank than said respective other ribs and projected beyond said web portion at said respective other end of said web portion; and said next adjacent rib being tapered having a side surface having a smooth inclined surface angled obliquely toward said web portion as said next adjacent rib projects from said base plank;

said next adjacent rib so adapted to align coacting marginal portions of said pair of fastener strips and to guide said marginal portions into interlocking relationship.

* * * * *